United States Patent [19]

Sato

[11] 4,354,469

[45] Oct. 19, 1982

[54] FUEL INJECTION APPARATUS IN MOTORIZED TWO-WHEELED VEHICLE

[75] Inventor: Toshihiko Sato, Oi, Japan

[73] Assignee: Honda Giken Kogyo Kabushiki Kaisha, Tokyo, Japan

[21] Appl. No.: 269,959

[22] Filed: Jun. 3, 1981

[30] Foreign Application Priority Data

Jun. 24, 1980 [JP] Japan ..... 55/84583

[51] Int. Cl.[3] ..... F02M 5/10

[52] U.S. Cl. ..... 123/460; 123/511; 123/514; 180/219

[58] Field of Search ..... 123/457–461, 123/510–516, 446, 472; 180/219

[56] References Cited

U.S. PATENT DOCUMENTS 4,155,332 5/1979 Yaegashi et al. ..... 123/480

OTHER PUBLICATIONS

"Cycle World", Magazine, Apr. 1982, p. 38.

"Cycle World", Magazine, Jun. 1982, p. 34.

*Primary Examiner*—Tony M. Argenbright

*Attorney, Agent, or Firm*—Armstrong, Nikaido, Marmelstein & Kubovcik

[57] ABSTRACT

A fuel injection apparatus for use in a motorized two-wheeled vehicle comprising a vehicle body, front and rear wheels mounted thereon, a side stand mounted on one side thereof, and a multi-cylinder type internal combustion engine mounted on the center portion thereof. The engine includes plural cylinders positioned laterally with respect to the body, plural fuel injection nozzles, a fuel pump, and a delivery pipe for delivering fuel supplied from the fuel pump to the plural nozzles, wherein the plural nozzles are disposed laterally in the direction of the plural cylinders and the delivery pipe is disposed laterally in the direction of the plural nozzles. The engine further includes a fuel pressure regulator coupled to one end portion of the pipe, the one end portion being on the opposite side of the side of the vehicle body having the side stand.

1 Claim, 3 Drawing Figures

FUEL INJECTION APPARATUS IN MOTORIZED TWO-WHEELED VEHICLE

BACKGROUND OF THE INVENTION

1. Field of the Invention

This invention relates to a fuel injection apparatus in a motorized two-wheeled vehicle such as a motorcycle or the like.

2. Description of the Prior Art

As to an apparatus of this kind, there has been hitherto known a vehicle body having front and rear wheels provided at its middle portion with a multi-cylinder type internal combustion engine comprising plural cylinders disposed in line, laterally. The engine is provided with plural fuel injection nozzles which are supplied with fuel from a fuel pump through a delivery pipe. In an apparatus of this type, it is possible for air to be introduced into the pipe.

SUMMARY OF THE INVENTION

It is the primary object of the present invention to provide an apparatus for automatically discharging the air from the pipe when, for instance, the engine is idling during parking of the vehicle with the vehicle body being in an inclined parking condition by using a side stand.

This invention is directed to a vehicle body having front and rear wheels and having at its middle portion a multi-cylinder type internal combustion engine comprising plural cylinders disposed laterally, and provided with plural fuel injection nozzles. The plural nozzles are disposed laterally along the direction of the plural cylinders, and a delivery pipe for delivering fuel supplied from a fuel pump to the plural nozzles is provided laterally along the disposed direction of the plural nozzles. The pipe is provided, at one end portion which is on the opposite side of the vehicle body from the side stand, with a fuel pressure regulator.

DETAILED DESCRIPTION OF THE PREFERRED EMBODIMENT

Figure 1:
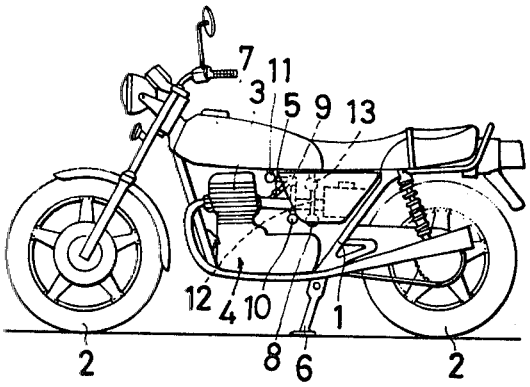
FIG. 1 is a side view of the motorcycle having the present invention.

Referring to the drawing, 1 is a vehicle body, and 2 is front and rear wheels thereof. The vehicle body 1 is provided at its middle portion with a multi-cylinder type internal combustion engine 4 having plural cylinders 3 disposed in line laterally. Thus, as a whole, there is constructed a motorized two-wheeled vehicle of motorcycle type.

The engine 4 is provided with plural fuel injection nozzles 5, and the vehicle body 1 has on one side thereof a side stand 6 for parking. A fuel tank 7 is mounted above the engine 4, and a fuel pump 8 is below the fuel tank 7. A delivery pipe 9 delivers the fuel supplied from the fuel pump 8 to the plural nozzles 5, and an oil filter 10 is provided on a delivery side of the fuel pump 8.

Figure 3:
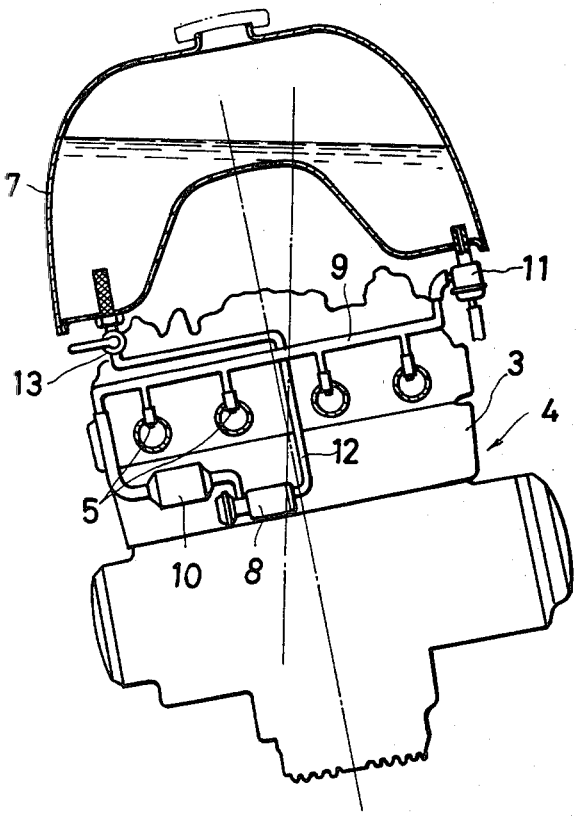
FIG. 3 is an enlarged rear side view thereof, partly in section.

The above is not significantly different from a conventional motorcycle engine and fuel system. According to the present invention, as shown in FIG. 3, the plural nozzles 5 are disposed in line laterally in the direction of the plural cyclinders 3, and the pipe 9 is positioned above the same so as to extend laterally along the line of the nozzles 5. The pipe 9 is provided with a fuel pressure regulator 11 at one end portion, which is located on the opposite side of the side stand 6.

The regulator 11 is opened at its delivery side to the interior of the fuel tank 7 which is located above the pressure regulator and the pipe 9 is connected at its other end portion to the fuel pump 8 through the oil filter 10. The pump 8 is in communication at its inlet side with the tank 7 through a fuel pipe 12. A fuel cock 13 is interposed in the fuel pipe 12.

Figure 2:
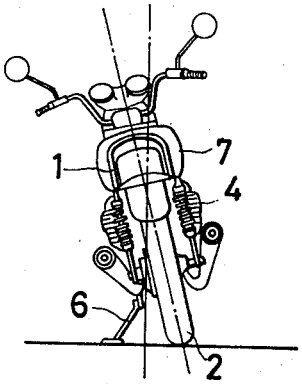
FIG. 2 is a rear side view thereof.

The operation of this invention apparatus will be explained as follows:

When the vehicle is in its parked condition using the side stand 6, the vehicle body 1 is inclined towards the side stand 6 side as shown in FIG. 2, and the delivery pipe 9 is brought into a corresponding inclined condition in accordance with the inclination as shown in FIG. 3. In such an inclined state, the side of stand 6 is low and the opposite side of the body is high. In other words, the pipe 9 is brought into a condition as shown where the one end portion thereof on the side having the regulator 11 is high.

When in this inclined condition, if the engine 4 is brought in its idling operation, the air contained more or less in the pipe 9 is moved to the right in the drawing because of the inclination and is discharged automatically from the regulator 11 on the one end portion thereof. Thus, air is prevented from entering into the engine which is liable to occur in a conventional system.

Thus, according to this invention, discharging of air from the delivery pipe is automatically carried out by utilizing the inclination of the vehicle body at the time of parking thereof.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A fuel injection apparatus for use in a motorized two-wheeled vehicle comprising a vehicle body, front and rear wheels mounted thereon, a side stand mounted on one side thereof, and a multi-cylinder type internal combustion engine mounted on the center portion thereof, said engine including plural cylinders positioned laterally, with respect to said body, plural fuel injection nozzles, a fuel pump, a delivery pipe means for delivering fuel supplied from said fuel pump to said plural nozzles, wherein said plural nozzles are disposed laterally in the direction of said plural cylinders and said delivery pipe means is disposed laterally in the direction of said plural nozzles, and a fuel pressure regulator coupled to one end portion of said pipe means, said one end portion being on the opposite side of the side of the vehicle body having said side stand.

* * * * *